US006138326A

United States Patent [19]

Pinto

[11] Patent Number: 6,138,326

[45] Date of Patent: Oct. 31, 2000

[54] MOTE KNIFE

[76] Inventor: Akiva Pinto, P.O. Box 1100-171, Gastonia, N.C. 28053-1100

[21] Appl. No.: 09/441,304

[22] Filed: Nov. 16, 1999

[51] Int. Cl.[7] ..... D01G 15/02

[52] U.S. Cl. ..... 19/104; 19/108; 19/113; 19/200

[58] Field of Search ..... 19/98, 99, 100, 19/104, 105, 106 R, 108, 109, 110, 112, 113, 200, 202, 204

[56] References Cited

U.S. PATENT DOCUMENTS

| | | | |
|---|---|---|---|
| 2,983,966 | 5/1961 | Brown et al. | 19/105 |
| 3,854,170 | 12/1974 | Cauglin | 19/202 |
| 4,505,005 | 3/1985 | Staehli | 19/200 |
| 4,805,268 | 2/1989 | Leifeld | 19/105 |
| 4,972,552 | 11/1990 | Graf | 19/113 |
| 5,107,571 | 4/1992 | Marzoli et al. | 19/105 |
| 5,241,726 | 9/1993 | Pezzoli et al. | 19/200 |
| 5,448,800 | 9/1995 | Faas et al. | 19/108 |
| 5,697,126 | 12/1997 | Baker, Jr. | 19/200 |

*Primary Examiner*—John J. Calvert
*Assistant Examiner*—Gary L. Welch
*Attorney, Agent, or Firm*—Henry S. Jaudon; Cort Flint

[57] ABSTRACT

A mote knife for use with a cleaning system including a rotating cylinder which creates a binary air flow while which entrains a fiber web formed of fibers of various fiber lengths about a circular path. A waste removal duct is arranged adjacent the periphery of the cylinder. A mote knife, which includes a contact surface positioned adjacent the periphery of the cylinder, a front edge located a first distance from the periphery of the cylinder, an intermediate edge located a second distance from the periphery of the cylinder and a rear edge located and a third distance from the periphery of the cylinder. A first channel is formed between the periphery and the front and intermediate edges which converges toward the intermediate edge. A second channel is formed between the periphery and the intermediate and rear edges which diverges toward the rear edge. Rotation of the cylinder creates a venturi effect at the intermediate edge which brings the flow of binary air to its greatest velocity. The air flow leading to the intermediate edge draws loose longer fibers back into the web. The velocity of air flow beyond the intermediate edge drops rapidly allowing dust, trash, and short fibers to lift away from the cylinder due to centrifugal force.

15 Claims, 1 Drawing Sheet

MOTE KNIFE

BACKGROUND OF THE INVENTION

This invention is directed to a mote knife of particular construction for use in a fiber cleaning system.

The use of mote knives of various constructions for use in fiber cleaning operations, particularly fiber web cleaning such as in carding machines, is well known throughout the industry. Conventional fiber cleaning arrangements are illustrated in U.S. Pat. Nos. 5,613,287, 5,890,264 and 5,926,919. The mote knife structures, in each of theses patents, are arranged a selected distance from the fiber web which is carried by a rotating cylinder. The front edge of the mote knives are adjacent the fiber web while the remaining structure diverges away from the cylinder in a uniform progressive manner. This structure results in the unnecessary loss of the longer fibers due to unnecessary breakage during removal of the dust and trash from the fiber web.

The instant invention has for its object a mote knife which bring about improved cleaning of broken fibers, dust and trash from fiber webs.

Another object of the invention is a mote knife which creates a binary air flow of increasing and decreasing velocities during the fiber cleaning operation.

Another object of the invention of the invention is a mote knife which creates channels of progress and regressive sizes between its lower surfaces and a fiber carrying cylinder.

Another object of the invention is a mote knife structure which creates along with the periphery of the fiber carrying cylinder, an increase and a decrease in the velocity if the binary air flow.

Another object of the invention is a mote knife structure which brings about an improved retention of longer fibers of the fiber web during fiber cleaning.

Another object of the invention is a mote knife structure which reduces the number of fibers broken during cleaning.

SUMMARY OF THE INVENTION

The invention comprises a mote knife for use with fiber cleaning systems which include a rotating cylinder entraining a fiber web of fibers of various fiber lengths about a circular path. Rotation of the cylinder creates a flow of binary air which assists in waste removal through a duct located adjacent a portion of the periphery of the cylinder. The mote knife includes a contact surface which is positioned adjacent the periphery of the cylinder within the duct. The mote knife has a front edge located a first distance from the periphery of the cylinder, an intermediate edge located a second distance from the periphery of the cylinder and downstream of the front edge and a rear edge located at a third distance from the periphery of the cylinder, and downstream of the intermediate edge. A first channel is formed between the periphery and the front edge and intermediate edges. The first channel converges toward the intermediate edge of the mote knife. A second channel is formed between the periphery and the intermediate edge and rear edge. The second channel diverges toward the rear edge of the mote knife.

Rotation of the cylinder creates a flow of binary air about the cylinder which acts along with the centrifugal force to lift and urge outwards certain of the fibers, trash and dust as the cylinder passes the intake of the duct. The front edge of the mote knife acts to disengage the lifted trash and dust from the web so that it may be removed through the waste removal duct. The first channel acts to increase the velocity of the air flow as the cylinder passes through while the converging contact surface of the mote knife forces or guides longer of the fibers which have become partially detached against the cylinder and into the fiber web. As the cylinder moves into the area of the second channel a drop in binary air flow occurs allowing centrifugal force to again urge outward the retained trash and broken fibers to again be removed through the waste removal duct.

The distance between front edge of the mote knife and the periphery of the cylinder is between 0.5 and 0.8 mm. The distance between the intermediate edge of the mote knife and the periphery of the cylinder is between 0.2 and 0.4 mm. The distance between the rear edge of the mote knife and the periphery of the cylinder is between 0.8 and 1.5 mm.

The mote knife includes a pivotal mount axially spaced from the intermediate edge which allows the spacings of the front and rear edges of the mote knife from the cylinder to be adjusted. The distance of the intermediate edge from the cylinder preferably remains substantially constant.

Preferably t he front edge and the intermediate edge are separated by between 10 and 15 mm while the rear edge and the intermediate edge are separated by at least 20 mm.

The space between the intermediate edge and the periphery of the cylinder along with the configuration of the first channel create a venturi effect which brings the flow of binary air to its maximum velocity at the intermediate edge. The suction created in the first channel acts to draw longer partially retained fibers back against the peripheral surface. An immediate reduction in the velocity of the binary air flow occurs as the cylinder passes the intermediate edge which causes the release of the short fibers, trash and dust which is removed through the removal duct.

DESCRIPTION OF THE DRAWINGS

The invention will be more readily understood from a reading of the following specification and by reference to the accompanying drawing forming a part thereof, wherein an example of the invention is shown.

DESCRIPTION OF A PREFERRED EMBODIMENT

Figure 1:
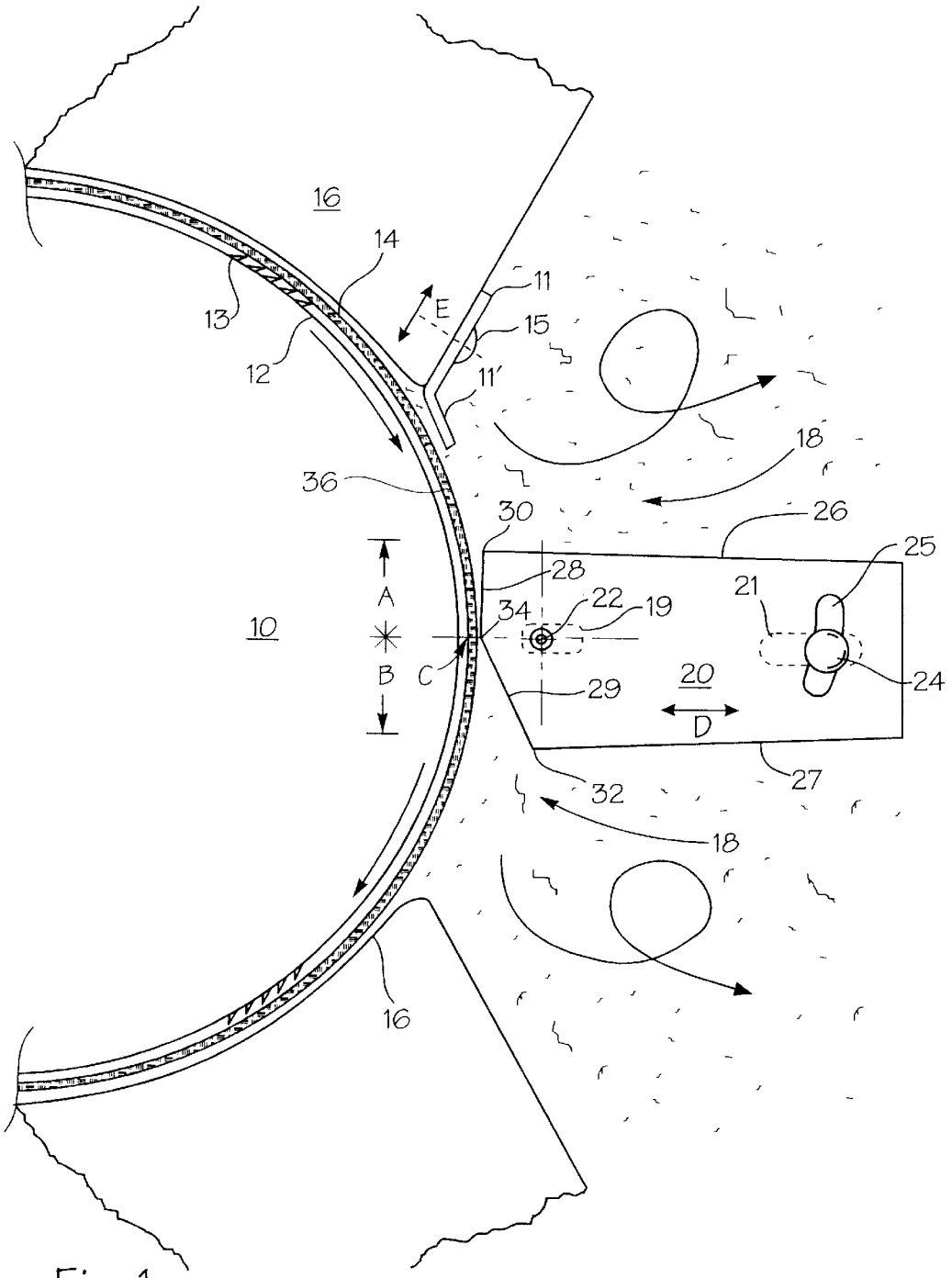
FIG. 1 is sectional diagrammatic side of the mote knife of the invention arranged adjacent a cylinder of a fiber cleaning device.

Turning now to the drawing, a sectional view of a fiber cleaning device, such as a carding cylinder of a carding machine, is shown. As is usual, a cylinder 10, which has its periphery 12 covered with teeth 13, is shown rotating in the direction of the arrows. A channel 14 is formed between periphery 12 and the inner walls of housing 16 in the usual manner. A channel adjusting shoulder 11 is secured to housing 16 adjacent opening 18. Shoulder 11 includes a lower foot 11' which is shaped to conform with periphery 12. Bolt 15, secured with housing 16 allows vertical movement of shoulder 11 relative to cylinder 10 in the direction of arrow E. Shoulder 11 acts to adjust the velocity of the binary air flowing into opening 18 which regulates the waste being removed from the fiber web. Openings 18 are created at spaced intervals about the periphery of channel 14 which act as ducts for the removal of trash, dust and broken fibers from fiber web 36 carried by the cylinder. Normally the duct is connected with a waste collection area.

Intermediate of open area 18, the mote knife of the invention is illustrated at 20. It is noted that both opening 18 and mote knife 20 extend completely across the length of cylinder 10. The width of the opening may vary as desired and the location of the mote knife within the opening may also vary as desired, i.e. mote knife 20 may be nearer to one edge.

Mote knife 20 is attached to the housing of the fiber cleaning machine by pivot member 22 and a securing member. The securing member may comprise a bolt 24 fitted through slot 25 which allows adjustment of the lower edge of the mote knife relative to periphery 12 cylinder 10.

Mote knife 20 includes a forward or front surface 26 and a rear or back surface 27. A contact surface 28, 29 is formed adjacent the periphery 12 of cylinder 10 and extends from the front surface 26 to the rear surface 27. Contact surface 28 forms a front edge 30 where it joins with front surface 26. Contact surface 28 forms rear edge 32 where it joins with rear surface 27. Contact surfaces 28 and 29 form an intermediate edge 34 where they join.

Front edge 30 is spaced from intermediate edge 34 by between 10–15 mm as indicated at A and is spaced slightly from a vertical line drawn through edge 34. Rear edge 32 is spaced at least 20 mm from intermediate edge 34 as shown at B and is spaced at a greater angle from the vertical line drawn through intermediate edge 34. Surfaces 28 and 29 are configured so that front edge 30 and back edge 32 form acute angles with an axis vertically through intermediate edge 34.

Intermediate edge 34 is normally set at 0.3 mm from periphery 12 as indicated at C. This distance may vary slightly between 0.2 and 0.4 mm depending on the fibers being processed. A pair of slots 19, 21 are formed in the housing wall, as indicated in broken lines, allowing pivot member 22 and bolt 24 to adjust which allows movement of mote knife 20 in the direction of arrow D. Again, the adjustment selected is dependent upon the fibers being processed and the result desired.

In operation a fiber sheet or web 36 is engaged by teeth 13 and carried through the cleaning process about periphery 12 of drum or cylinder 10. Cylinder 10 while moving fibers 36 through the opening created between inner wall 16 of the machine housing and periphery 12 creates a flow of binary air moving in the direction of the cylinder. As a portion of periphery 12 passes into and through opening 18, the velocity of the binary air flow drops which acts to lift and, along with centrifugal force, propel outward dust, trash, and broken fibers from the fiber web into opening or duct 18. A number of longer fibers are also partially withdrawn or separated from the fiber web and extend toward opening 18 as the cylinder moves toward mote knife 20.

A normal mote knife would have its forward edge forming the point nearest the periphery of cylinder 10. In this position, the edge of the mote knife would strike the extended portion of the partially held longer fibers adjacent the fiber web breaking them off and creating excessive waste.

Edge 30 of the mote knife of the invention is sufficiently spaced from the cylinder and contact surface 28 is properly positioned so that the outer extremities of the extended portion of the partially held fibers are engaged and directed back toward periphery 12 and into engagement with fiber web 36. Due to the funnel shape of the space or the channel formed between edge 30 and intermediate edge 34, a venturi effect is created at C which causes the velocity of the binary air flow to begin to increase adjacent edge 30 and to continue to increase until a maximum velocity is created at intermediate edge 34.

Upon passing intermediate edge 34, the diverging channel created by surface 29, diverges toward edge 32, causes an instant reduction in the velocity of the binary air flow as the cylinder moves toward opening 18 on the rear side of mote knife 20. The reduction in velocity of the binary air flow along with centrifugal force again causes dust, trash, and broken fibers to separate from web 36 and fall away from cylinder 10 through opening 18.

The dual operation as described provides an improved trash, dust, and broken fiber removal process while at the same time provides for less fiber breakage and resulting waste.

While a preferred embodiment of the invention has been described using specific terms, such description is for illustrative purposes only, and it is to be understood that changes and variations may be made without departing from the spirit or scope of the following claims.

What is claimed is:

1. A mote knife for use with a cleaning system including a rotating cylinder creating a binary air flow while entraining fibers of various fiber lengths of a fiber web about a circular path and a waste removal duct having an intake adjacent a portion of the periphery of said cylinder through which air passes toward a collection area, wherein, said mote knife includes a contact surface which is positioned adjacent the periphery of said cylinder within said intake, said mote knife having a front edge located a first distance from the periphery of said cylinder wherein the front edge and back edge form acute angles with an axis vertically through an intermediate edge, said intermediate edge located a second distance from said periphery downstream of said front edge and a rear edge located a third distance from said periphery, downstream of said intermediate edge;

a first channel, formed between said front edge, said intermediate edge, and said periphery converges toward said intermediate edge;

a second channel formed between said intermediate edge, said rear edge, and said periphery diverges away from said intermediate edge; wherein, rotation of said cylinder creates a flow of binary air about said cylinder which acts along with centrifugal force to lift certain of said fibers, trash and dust as said entrained fibers passes said intake with said front edge of said mote knife acting to disengage and direct said lifted trash and dust into said duct while said first channel acts to guide longer partially disengaged fibers back to said fiber web and to intensify said binary air flow as said cylinder passes through said first channel while passage through said second channel creates a drop in binary air flow again releasing and urging outward retained trash and broken fibers.

2. The mote knife of claim 1 wherein said first distance is between 0.5 and 0.8 mm from said periphery and said third distance is between 0.2 and 0.4 mm from said periphery.

3. The mote knife of claim 2 wherein said second distance is between 0.8 and 1.5 mm.

4. The mote knife of claim 1 wherein said mote knife includes a pivotal mount axially spaced from said intermediate edge whereby the spacing of said front and rear edges from said cylinder may be adjusted while the distance from said cylinder of said intermediate edge remains substantially constant.

5. The mote knife of claim 1 wherein said front edge and said intermediate edge are spaced by between 10 and 15 mm.

6. The mote knife of claim 1 wherein said rear edge and said intermediate edge are spaced by between 5 and 20 mm.

7. The fiber cleaning system of claim 6 wherein said intermediate edge and said periphery create a venturi effect which brings said flow of binary air to maximum velocity.

8. The fiber cleaning system of claim 6 wherein said cleaning system comprises a carding machine.

9. The fiber cleaning system of claim 6 wherein a plurality of said mote knives and said ducts are arranged about said periphery.

10. The fiber cleaning system of claim 6 including means to adjust the setting between the intermediate edge and said rotating cylinder.

11. The fiber cleaning system of claim 6 including a housing forming a delivery channel between said rotating cylinder and an inner surface of said housing, said rotating cylinder creating a binary air flow within said delivery channel.

12. The fiber cleaning system of claim 11 including a shoulder having a foot positioned adjacent an end of said delivery channel, said shoulder being adjustable relative to said rotating cylinder whereby the velocity of said binary air flow may be adjusted.

13. A fiber cleaning system for use with fiber preparation apparatus having a fiber transporting rotating cylinder, said system comprising:

a waste collection area;

a duct leading to said collection area having a receiving end located adjacent the periphery of said rotating cylinder and a binary air flow moving about said periphery and through said duct to said collection area;

a mote knife positioned adjacent said rotating cylinder dividing said receiving end of said duct, said mote knife having a front edge an intermediate edge and, a rear edge wherein the front edge and rear edge form acute angles with an axis vertically through the intermediate edge and a shaped contact surface forming a first channel between the periphery of said rotating cylinder and said front edge and said intermediate edge and a second channel between the periphery of said cylinder and said intermediate edge and said rear edge;

said front edge acting to engage separated dust, trash and broken fibers from said transported fibers which are lifted away from said cylinder by centrifugal force and said binary air flow, said trash and broken fibers being removed through said duct along a front side of said mote knife as said cylinder moves over said receiving end of said duct and, continued movement of said cylinder through said first channel creates an increase in velocity of said binary air flow which forces longer partially separated fibers back into said web while movement of said cylinder through said second channel creates a drop in velocity of said binary air flow which again causes said retained trash and broken fibers to lift from said cylinder and separate from said web to be removed through said duct along said rear edge of said mote knife.

14. A fiber cleaning system for use with fiber preparation apparatus having a housing and a fiber transporting rotating cylinder, said system comprising:

a delivery channel formed between said housing and said rotating cylinder a waste collection area;

a duct leading to said collection area having a receiving end connected with said delivery channel for receiving a binary air flow moving about the periphery of said cylinder through said delivery channel where dust, trash, and broken fibers are separated from said transported fibers;

a mote knife positioned adjacent said rotating cylinder dividing said receiving end of said duct, said mote knife having a front edge an intermediate edge and, a rear edge wherein the front edge and rear edge form acute angles with an axis vertically through the intermediate edge and a shaped contact surface forming a first channel between the periphery of said rotating cylinder and said front edge and said intermediate edge and a second channel between the periphery of said cylinder and said intermediate edge and said rear edge;

said front edge acting to engage said separated dust, trash and broken fibers which are lifted away from said cylinder by centrifugal force and said binary air flow, said dust, trash and broken fibers being removed through said duct along a front side of said mote knife as said cylinder moves over said receiving end of said duct and, continued movement of said cylinder through said first channel toward said intermediate edge creates an increase in velocity of said binary air flow which forces longer partially separated fibers back into said web while movement of said cylinder beyond said intermediate edge and through said second channel creates a drop in velocity of said binary air flow which again causes said retained trash and broken fibers to lift from said cylinder and separate from said web to be removed through said duct along said rear edge of said mote knife.

15. The fiber cleaning system of claim 14 including a shoulder located between said receiving end and said delivery channel, said shoulder being adjustable to vary the size of said delivery channel at said connection with said receiving end.

* * * * *